US010240780B2

(12) United States Patent
Deivasigamani et al.

(10) Patent No.: US 10,240,780 B2
(45) Date of Patent: Mar. 26, 2019

(54) HIGH TURN-DOWN MODULATING BURNER

(71) Applicants: Sridhar Deivasigamani, Peoria, IL (US); Sivaprasad Akasam, Dunlap, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 10 days.

(21) Appl. No.: 15/706,804

(22) Filed: Sep. 18, 2017

(65) Prior Publication Data

US 2018/0003380 A1 Jan. 4, 2018

Related U.S. Application Data

(62) Division of application No. 14/600,266, filed on Jan. 20, 2015, now Pat. No. 9,797,596.

(51) Int. Cl.

| | |
|---|---|
| ***F23D 14/60*** | (2006.01) |
| ***F23D 14/58*** | (2006.01) |
| ***F24H 9/18*** | (2006.01) |
| *F24H 1/43* | (2006.01) |

(52) U.S. Cl.

CPC ..... *F23D 14/60* (2013.01); *F23D 14/58* (2013.01); *F24H 9/1836* (2013.01); *F23D 2203/1012* (2013.01); *F23D 2900/00003* (2013.01); *F23D 2900/14481* (2013.01); *F24H 1/43* (2013.01)

(58) Field of Classification Search

CPC .. F23D 14/58; F23D 14/60; F23D 2203/1012; F23D 2900/14481; F23D 2900/00003; F28D 7/024; F28D 1/0472; F24D 2200/08; F24D 2200/26; F24D 2200/14; F28F 2255/14; F28F 2215/04; F28F 2265/12; F28F 2009/0292; F28F 1/24; F28F 13/06; F28F 1/36; F28F 1/44; F24H 2240/04; F24H 1/43; F24H 9/0026; F24H 1/44; F24H 8/00; F24H 9/1836; F24H 1/186; F24H 1/208; F24H 1/34; F24H 1/165; Y02B 10/20; Y02B 10/70; Y02B 30/102; F16K 31/40; F16K 31/406;

(Continued)

(56) References Cited

U.S. PATENT DOCUMENTS 2,700,418 A * 1/1955 Gilmore ..... F23D 5/00 431/116
5,311,843 A * 5/1994 Stuart ..... F24H 1/43 122/18.4

* cited by examiner

*Primary Examiner* — Alfred Basichas
(74) *Attorney, Agent, or Firm* — Tracy Jong Law Firm; Tracy P. Jong; Cheng Ning Jong

(57) ABSTRACT

A high turn-down burner adapted to receive a fuel flow for combustion including an outer housing including a central axis, a side wall having a top edge and a bottom edge, a plurality of apertures disposed on the side wall, a top wall adjoining the side wall at the top edge and a bottom wall adjoining the side wall at the bottom edge; an inner housing including a central axis, a side wall, a plurality of apertures disposed on the side wall, the inner housing is coaxially rotatable with respect to the outer housing; and an actuator adapted to harness and convert the power exerted by the fuel flow to a movement of the inner housing with respect to the outer housing, wherein the alignment of the apertures of the inner and outer housings is adapted to modify an effective combustion area of the burner.

5 Claims, 8 Drawing Sheets

(58) Field of Classification Search
CPC ..... F16K 31/408; F16K 31/163; F16K 31/02;
F02M 21/02; F02M 21/0233
See application file for complete search history.

HIGH TURN-DOWN MODULATING BURNER

PRIORITY CLAIM AND RELATED APPLICATIONS

This divisional application claims the benefit of priority from non-provisional application U.S. Ser. No. 14/600,266 filed on Jan. 20, 2015 and provisional application U.S. Ser. No. 61/929,146 filed on Jan. 20, 2014. Each of said applications is incorporated by reference in its entirety.

BACKGROUND OF THE INVENTION

1. The Field of the Invention

The present invention is directed generally to a high turn-down modulating burner. More specifically, the present invention is directed to a high turn-down modulating burner of the burner tube type where the burner is disposed such that its central axis is disposed vertically while in use.

2. Background Art

Prior art burners include fixed surface areas at which combustion occurs, fixed volume conductors directing fuel to fixed surface areas at which combustion occurs and are either rectangular or cylindrical in shape. The fixed surface areas may include punched holes of various diameters, slots or interwoven metallic fibers/cross-hatched sintered metal fiber. The sizes of orifices or openings through which gas mixture is supplied to the surface areas are fixed due to the fixed punched hole/slot sizes or mat density or density of fiber weaving. Therefore, given fixed surfaces areas at which combustion occurs, prior art burners are incapable of supporting combustion at a very low combustion rate. For example, when modulated to a low flow of gas, the supply of gas is insufficient to be spread across now relatively large combustion surface areas to support combustion. Therefore, prior art burners may only support a minimum heat output setting that is still quite large, even when a heating demand does not justify this setting.

In order to achieve the effect of a high turn-down at low heat output regions, burners may also be shut off periodically. Upon shut off, the amount of materials heated can drop rapidly, potentially causing discomfort to users of such materials. Cycling frequency of the burner can be also be quite high, leading to energy losses and inefficiencies caused in the need to purge during both the shut-down and start-up phases. In addition, typical start-up times for burners can be quite long, leading to an inability to respond to sudden load demands.

Thus, there arises a need for a burner capable of a high turn-down ratio and one in which the effective combustion area is adjustable to accommodate heating demands without the need to shut off burners.

SUMMARY OF THE INVENTION

In one embodiment, the present invention is directed toward a high turn-down burner adapted to receive a fuel flow for combustion. The burner includes:

(a) a housing including a side wall having a top edge, a bottom edge, an interior surface forming an inner periphery, a bottom wall adjoining the side wall at the bottom edge, a top wall adjoining the side wall at the top edge and a plurality of apertures disposed on the side wall;

(b) a supply tube adapted through the top wall of the housing, the supply tube comprising a top end, a bottom end and a side wall having an outer surface forming an outer periphery, wherein the supply tube is adapted to receive the fuel flow at the top end of the supply tube; and (c) a disk having a weight and an opening adapted to accommodate the supply tube, wherein the disk is configured to slide along a length of the supply tube within the space delineated by the inner periphery of the housing and the outer periphery of the supply tube, wherein the fuel flow is configured to exert a force equivalent to the weight of the disk thereby sustaining an optimal flowrate of the fuel flow through a plurality of apertures below the disk.

In one embodiment, the present burner further includes a travel limiter disposed on the bottom end of the supply tube for limiting the travel of the disk along the length of the supply tube.

In a second embodiment, the present invention is directed toward a burner adapted to receive a fuel flow for combustion. The burner includes:

(a) an outer housing comprising a central axis, a side wall having a top edge and a bottom edge, a plurality of apertures disposed on the side wall, a top wall adjoining the side wall at the top edge and a bottom wall adjoining the side wall at the bottom edge;

(b) an inner housing comprising a central axis, a side wall, a plurality of apertures disposed on the side wall, wherein the inner housing is configured to be coaxially inserted in the outer housing such that the inner housing is coaxially rotatable with respect to the outer housing; and (c) an actuator adapted to harness and convert the power exerted by the fuel flow to a movement of the inner housing with respect to the outer housing, wherein the alignment of the plurality of apertures of the inner housing and the plurality of apertures of the outer housing are configured such that the movement is adapted to modify an effective combustion area of the burner which is defined by the amount of overlap between the plurality of apertures of the inner housing and the plurality of apertures of the outer housing.

In one embodiment, the actuator includes:

(a) a supply tube adapted through the top wall of the outer housing, the supply tube comprising a side wall, a top end and a bottom end, wherein the supply tube is adapted to receive the fuel flow at the top end of the supply tube;

(b) a flap having a shaft fixedly attached to the flap, wherein the shaft is pivotably mounted within the lumen of the supply tube about a rotational axis, the shaft is disposed substantially perpendicularly to the fuel flow within the supply tube, the shaft extending from the flap and terminating in a pinion configured for rotational engagement with a rack mounted to a portion of an inner surface of the inner housing;

(c) a return spring secured at one end to a portion of an inner surface of the supply tube and at another end to a portion of the flap, wherein the flap is adapted to rotate about the rotational axis at a magnitude commensurate with the magnitude of the fuel flow to cause a relative rotation of the pinion with respect with the rack and the return spring is configured to return the flap to its neutral position when the fuel flow ceases.

In one embodiment, the burner further includes a fibrous burner surface disposed along an outer surface of the housing for aiding in distributing the fuel flow over the outer surface of the housing.

In one embodiment, each burner further includes an external housing disposed along an outer surface of the housing, the external housing having a side wall and a plurality of apertures disposed on the side wall of the external housing, wherein the plurality of apertures are configured for aiding in distributing the fuel flow over the outer surface of the housing or the outer housing.

In one embodiment, the fuel flow is a premixed fuel flow that is air-propane flow.

In another embodiment, the fuel flow is a premixed fuel flow that is air-natural gas flow.

Accordingly, it is a primary object of the present invention to provide a burner capable of a high turn-down ratio, thereby capable of maintaining efficient combustion in a wide range of fuel flowrates.

It is another object of the present invention to provide a burner capable of a high turn-down ratio and the high turn-down ratio is achieved through a means not requiring external power, i.e., power made available from outside of the burner.

It is a further object of the present invention to provide a burner that provides for automatic area compensation with respect to firing rate and allows for both an increased back pressure (as seen by the blower-gas valve train) and appropriate flame lift off (from burner surface) so as to not over heat the burner body including the housing, burner surface, external housing, etc.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
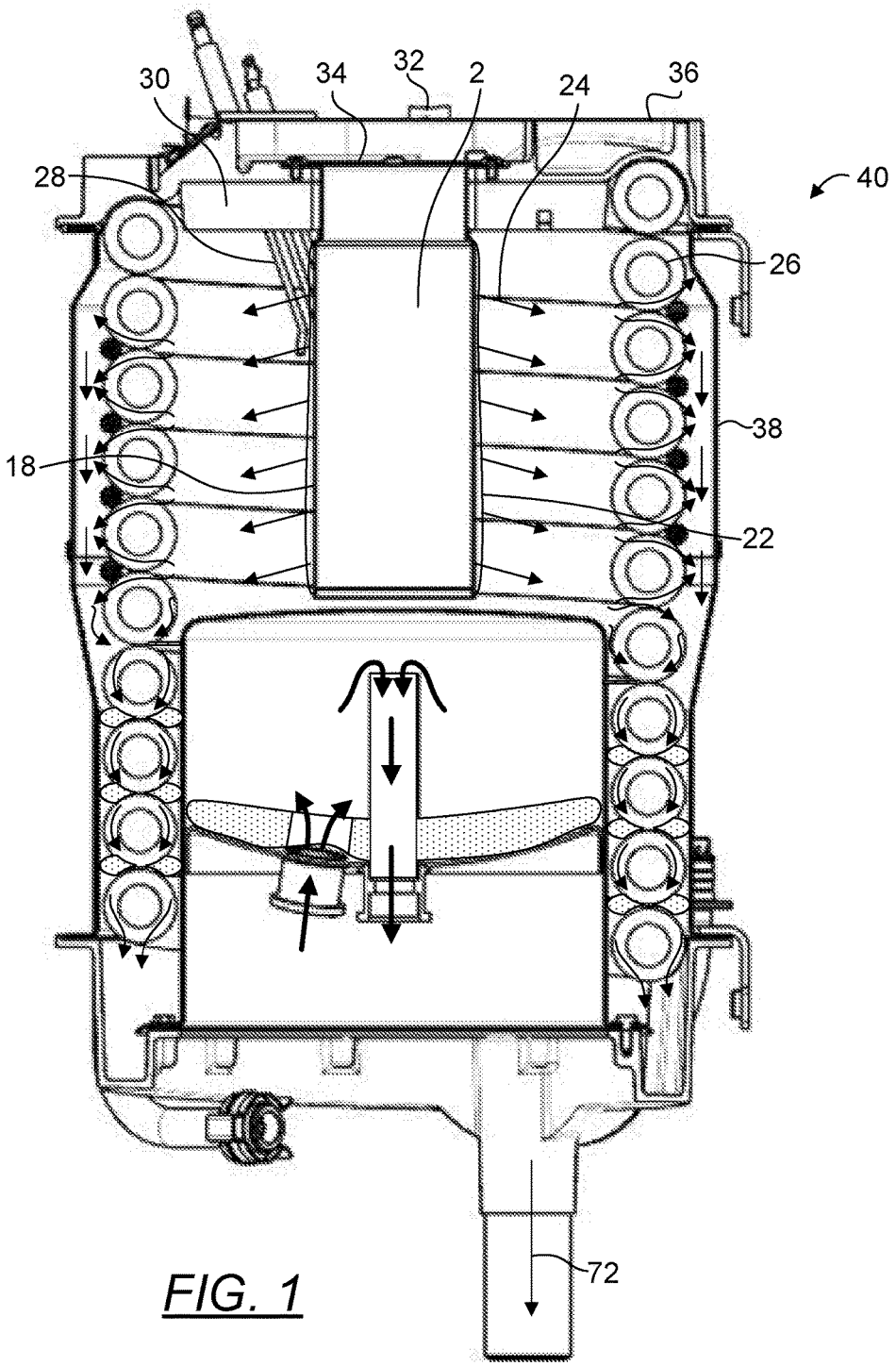
FIG. 1 is a cross-sectional view of a heat exchanger where a burner tube type burner is used.

2—burner
4—housing
5—inner periphery of housing
6—supply tube
7—outer periphery of supply tube
8—travel limiter
10—disk
12—fuel
14—fuel supplied space
16—fuel starved space
18—burner surface
20—top wall or flange
22—flame
24—direction of hot flue gas
26—coil tube
28—igniter
30—thermal insulator
32—input port of top casting
34—exit port of top casting
36—top casting
38—heat exchanger housing
40—heat exchanger
42—aperture of housing
44—inner housing
46—groove
48—lip
50—actuator
52—pinion
54—rack
56—point to which spring is attached at flap
58—return spring
60—point to which spring is attached at anchor of supply tube
62—flap
64—angular offset
66—aperture of inner housing
68—shaft
70—central axis of outer housing or inner housing
72—flue gas exit port

Particular Advantages of the Invention

A high turn-down ratio is achieved by regulating the pressure of a fuel flow being fed to the burner. In one embodiment, the pressure regulation of the fuel flow is achieved by providing a burner capable of adjusting the effective burner area based on whether the fuel flow has access to the apertures in the burner surface. A prominent fuel flow causes more apertures to be exposed, increasing the effective area through which the fuel flow can be supplied to the combustion surface of the burner. In another embodiment, the pressure regulation of the fuel flow is achieved by providing a burner capable of adjusting the size of the apertures through which the fuel flow can be supplied to the combustion surface of the burner.

The present burner is capable of a high turn-down ratio without requiring complex powered moving parts and any moving parts required are contained within the burner itself, thereby eliminating any leaks which may be caused by having a power supply and actuator interface to the environment outside of the burner. In both embodiments disclosed, the prominence of a fuel flow itself is used to modulate the size of the effective area on which combustion takes place, making for sustained combustion at the combustion surface of the burner especially at low flowrates of a fuel flow and efficient heating as the desired firing rate is also the actual firing rate. In contrast to low turn-down burners, the present burner can be modulated to a low firing rate as heating demand decreases. In control applications where precise temperature adherence is important, a present burner aids in preventing overshoot of target temperatures of a medium heated.

There is provided a burner which allows automatic (e.g., in this case, passive) combustion surface area compensation with respect to firing rate and allows for both an increased back pressure (as seen by the blower-gas valve train) and appropriate flame lift off (from burner surface) so as to not over heat the burner body including the housing, burner surface, external housing, etc.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower). The term "turn-down" is used herein to mean the width of the operational range of a burner. The magnitude of "turn-down" is herein expressed as a ratio, or a maximum heat output divided by a minimum heat output.

In order to show the environment in which a present burner can be used, FIG. 1 is provided. FIG. 1 is a cross-sectional view of a heat exchanger 40 where a burner 2 of the burner tube type is used. In this example, the burner 2 is attached to a top casting 36 at the exit port 34 of the top casting 36. In use, a fuel flow is drawn via the input port 32 of the top casting 36, through the top casting and into the burner 2. Combustion at the burner 2 causes thermal transfer from the burner 2 to water flowing through the coil tube 26 of the heat exchanger 40. The fuel flow then exits the burner 2 to a burner surface 18 on the exterior periphery of the burner which is subsequently consumed to generate heat. In one embodiment, the burner surface includes a fibrous material having orifices defined by the density of the fibrous material. The denser the fibrous material, the finer the orifices will be.

In another embodiment, this burner surface includes orifices defined by punched apertures disposed on an external housing. In yet another embodiment, the burner surface 18 is defined by the outermost housing of a burner as an additional housing (fibrous or punch-holed) surrounding such outermost housing is not used. Any flue gas generated by such combustion is contained within the heat exchanger housing 38 and channeled to a flue gas exit port.

A typical heat exchanger further includes a thermal insulator 30 for reducing thermal loss via the top casting 36 and an igniter 28 for starting a flame 22. The fuel used includes, but not limited to, a premixed air-propane or premixed air-natural gas. During operation, the flue gas generated due to combustion flows outwardly from the burner in direction 24 to the flue gas exit port 72. A blower disposed upstream of the burner forces a fuel flow through the burner and the flue gas generated at the burner to continue to the exit port 72.

Figure 2:
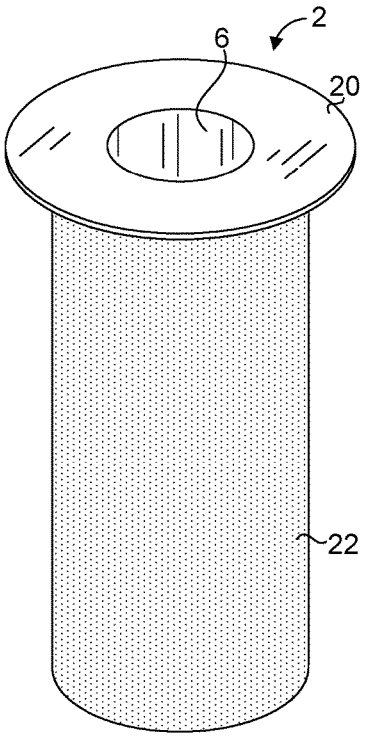
FIG. 2 is a perspective view of a burner tube type burner.
Figure 3:
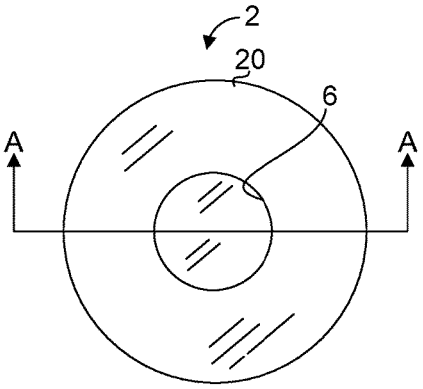
FIG. 3 is a top orthogonal view of the burner of FIG. 2.
Figure 4:
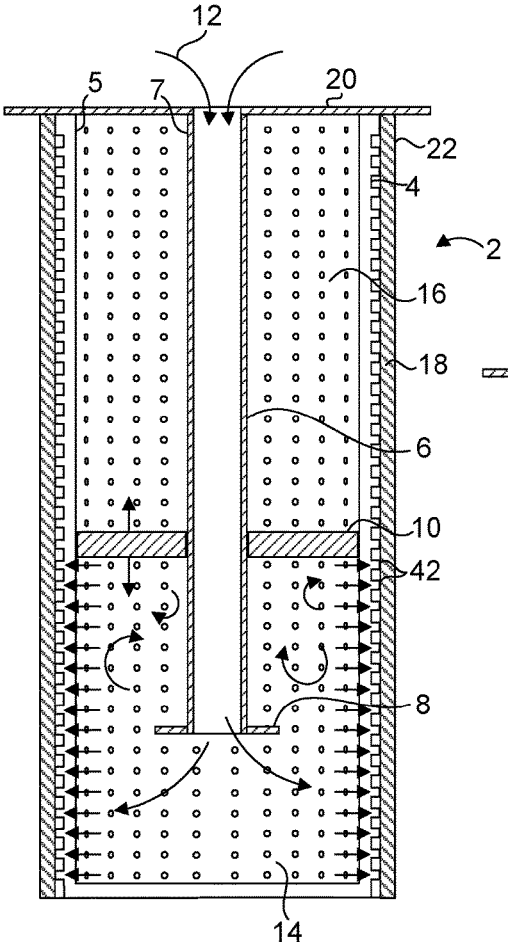
FIG. 4 is a partial orthogonal cross-sectional view of the burner of FIG. 3 taken along line AA of FIG. 3.

FIG. 2 is a perspective view of a burner 2 of the burner tube type. FIG. 3 is a top orthogonal view of the burner 2 of FIG. 2. FIG. 4 is a partial orthogonal cross-sectional view of the burner 2 of FIG. 3 taken along line AA of FIG. 3. In one embodiment, the outer structure of the burner 2 is essentially, but not limited to, a cylindrical or tubular structure encased on its side wall by a burner surface 18. The tubular structure includes a side wall that is closed on one end with a bottom wall and fixedly attached to a top wall 20 having a centrally disposed opening. A supply tube 6 is connected to the opening such that supply tube 6 becomes the only means for the burner 2 to receive a fuel flow from the top casting 36 to the cavity of the burner 2. During installation of a burner to the top casting 36, the top wall 20 is aligned with exit port 34 of the top casting and secured to the top casting 36 such that no leaks can occur through the space between the top casting 36 and the top wall 20. The supply tube 6 is essentially a tube used for channeling a fuel flow into the cavity of the burner 2 where a bottom flange 8 is disposed at its bottom end to serve as the bottom travel limit of the disk 10 configured to slide along the side wall of the supply tube 6 and the top wall 20 serves as the top travel limit of the disk 10. The disk 10 is preferably constructed from an excellent thermal insulator, e.g., ceramic, lightweight aluminum, stainless steel, and the like, to avoid any effects of overheating of the disk and to maximize heat transfer to the materials to be heated, e.g., materials carried in the coil tube 26, as shown in FIG. 1. It is conceivable that the housing, supply tube and disk be constructed in another shape, e.g. with a square or rectangular cross-section. However, the Applicants discovered that a cylindrical supply tube that is coaxially disposed with the housing works best as the number of potential pinch points are greatly reduced with a cylindrical housing and supply tube.

Figure 5:
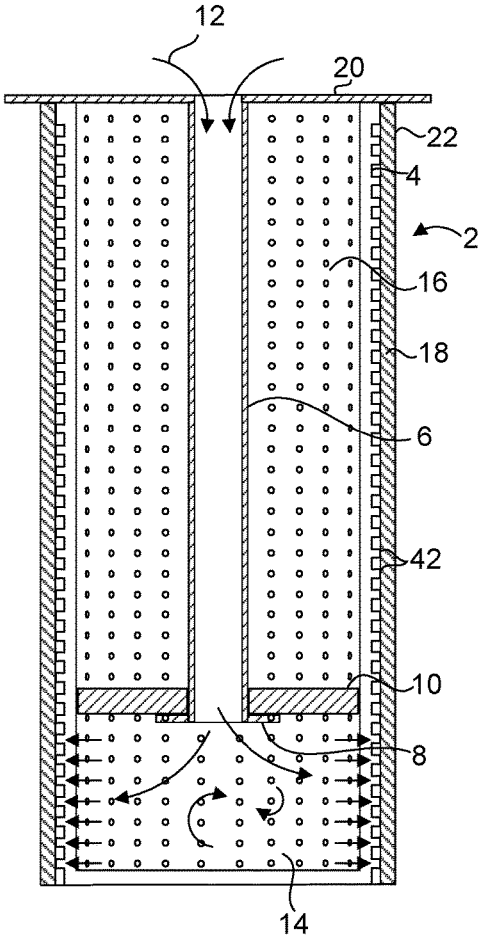
FIG. 5 is a partial orthogonal cross-sectional view of the burner of FIG. 4, depicting the disk disposed in a position corresponding to a fuel flow at the lowest flowrate setting.
Figure 6:
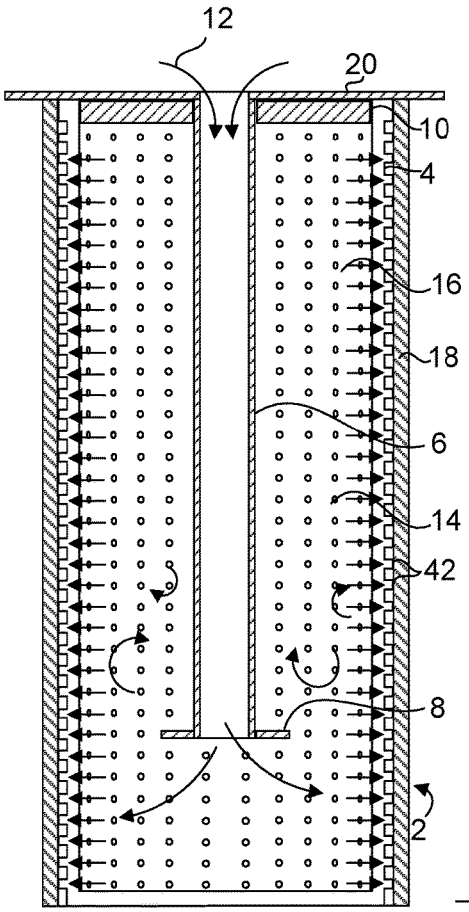
FIG. 6 is a partial orthogonal cross-sectional view of the burner of FIG. 4, depicting the disk disposed in a position corresponding to a fuel flow at the highest flowrate setting.

FIGS. 5 and 6 are partial orthogonal cross-sectional views of the burner 2 of FIG. 4, depicting the disk 10 disposed in a position corresponding to a fuel flow at the lowest and highest flowrate setting, respectively. It shall be noted in FIG. 5 that, at this flowrate, the fuel flow does not generate a sufficient uplifting force to sustain the disk 10 above the bottom flange 8. The disk 10 therefore rests upon the bottom flange 8, confining the fuel flow to the space 14 substantially below the bottom flange 8 and forcing the fuel flow to exit the apertures 42 accessible from this space 14. The space 16 above the disk 10 is therefore fuel starved and incapable of sustaining combustion or generating heat. The fuel 12 flow at its minimum setting is preferably configured to a flowrate just below the rate capable of lifting the disk 10. In FIG. 6, the space 16 above the disk 10 does not exist as the disk 10 is disposed at its upper limit along the supply tube 6, making for the maximum setting for space 14 and maximum access to the apertures 42. Compared to a constant volume burner, the present burner is capable of maintaining efficient combustion as the size of the effective burner surface is commensurate with the fuel flowrate. In a constant volume burner, if a fuel flowrate drops below a critical level, there will not be sufficient fuel flow to maintain an even distribution of fuel on the entire combustion surface. In contrast, the present burner is capable of maintaining an effective combustion surface area that is commensurate with the fuel flow, thereby allowing for a low firing rate when the fuel flowrate is low and a high firing rate when the fuel flowrate is high. The ratio of the high firing rate and low firing rate can then be higher than a conventional burner as the low firing rate of the present burner can be much lower than the low firing rate of a conventional or prior art burner. In one embodiment, the present burner 2 is capable of a heat rate ranging from about 30,000 BTU/hr. to about 250,000 BTU/hr. which is equivalent to the consumption of 30 Cubic Feet Per Hour (CFH) to 250 CFH of natural gas. In another embodiment, the present burner is adapted to provide a firing rate having a turn-down ratio of at least about 27:1 (e.g., in turning down from about 200,000 BTU/hr. to about 7,500 BTU/hr.). In one embodiment, the ratio of the number of blocked apertures 42 and the number of unblocked apertures 42 ranges from about 9/1 at low firing rate of 5% to about 0/10 at 60 to 100% firing rate. As the combustion area of the present burner can be adjusted, an increased back pressure (as experienced by the blower-gas valve train) can be effected. As a result, flames over the burner surface can be controlled to be lifted off from the burner surface so as to not over heat the burner body including the housing, burner surface, external housing, etc. Suitable disk weight and area upon which the fuel flow acts shall be configured to achieve the desired back pressure of the blower-gas valve train. It shall also be noted that the present burner is capable of reducing any potential backflow of flue gases through the burner in a multi-burner system having a common shared vent. In blower-equipped systems that lack measures to prevent backflow of flue gases from one or more burners to a non-functioning burner, flue gases can travel through the exit port of a heat exchanger, through a burner and into the blower area. As the effective combustion area of a present burner is proportional to the fuel flow magnitude, the availability of a through path for flue gas from another burner to flow through the present burner is greatly reduced as shown in the embodiment shown in FIGS. 1-9 as the number of fluid accessible apertures 42 in space 14 is greatly reduced or eliminated in the embodiment shown in FIGS. 10-14 as the amount of overlap of apertures 42 and 66 is eliminated.

Figure 7:
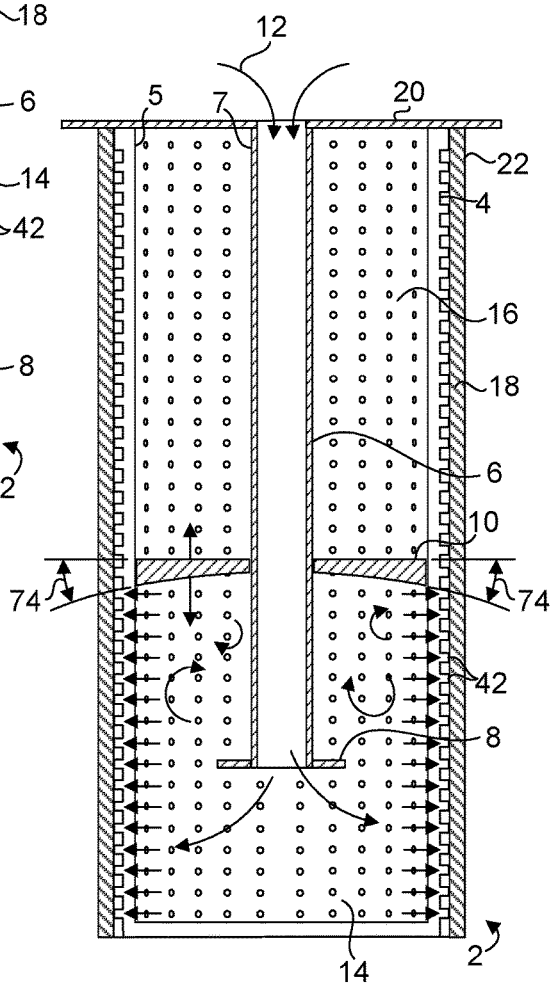
FIG. 7 is a partial orthogonal cross-sectional view of the burner of FIG. 4, depicting a disk having a concaved bottom surface.
Figure 8:
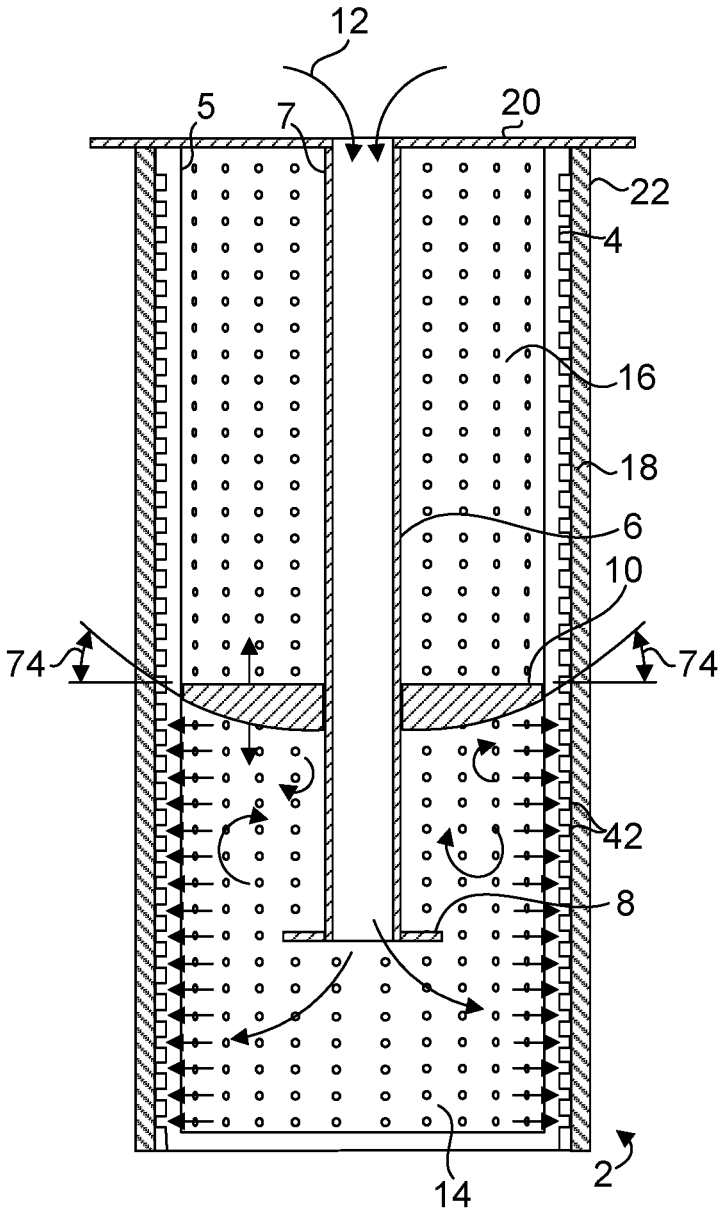
FIG. 8 is a partial orthogonal cross-sectional view of the burner of FIG. 4, depicting a disk having a convexed bottom surface.
Figure 9:
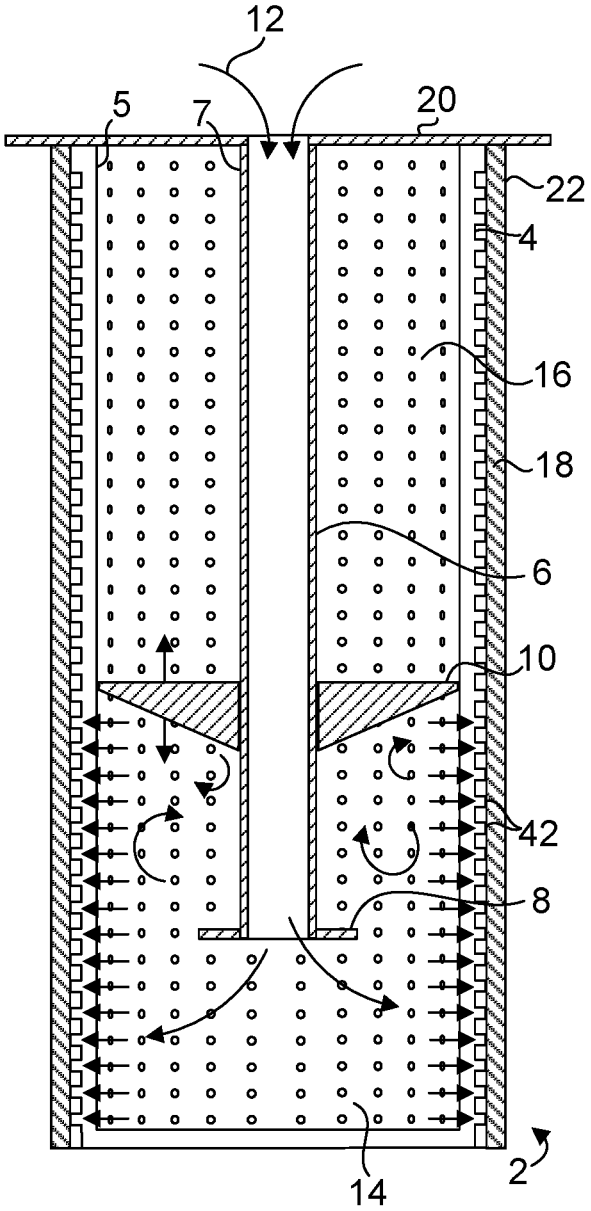
FIG. 9 is a partial orthogonal cross-sectional view of the burner of FIG. 4, depicting a disk having a frusto-conical bottom surface.

The surface upon which the fuel flow acts shall be configured such that the fuel flow acts to center the disk 10 within the pathway in which the disk 10 slides. In one embodiment, the disk possesses substantially parallel top and bottom surfaces. In another embodiment, the bottom surface of the disk is concaved as shown in FIG. 7. FIG. 8 depicts yet another embodiment of the disk 10, where in this case, its bottom surface is configured in a convexed shape. FIG. 9 depicts yet another embodiment of the disk 10, where in this case, its bottom surface is configured in a frusto-conical shape. In these embodiments, the surface upon which the fuel flow acts upon exiting the supply tube 6 is not parallel to the horizontal plane so as to reduce opportunities for the disk from getting cock-eyed and getting stuck within its pathway during its ascent or descent. Notice the concave bottom surface 74, convex bottom surface 74 or slanted bottom surface of the disk 10 in FIGS. 7-9. Suitable clearance between the inner periphery 5 of the housing and the disk 10 and between the outer periphery 7 of the supply tube 6 and the disk 10 shall be provided so as not to allow excessive leakage of fuel flow from space 14 to space 16 while allowing the disk to rise or drop substantially free of resistance.

Figure 10:
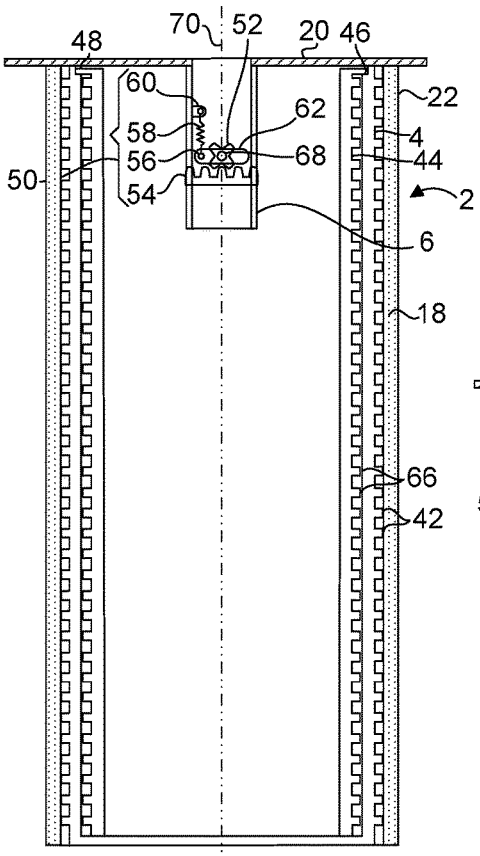
FIG. 10 is a partial orthogonal cross-sectional view of the burner of FIG. 3 taken along line AA of FIG. 3, depicting a second embodiment of the present burner with no fuel flow.
Figure 11:
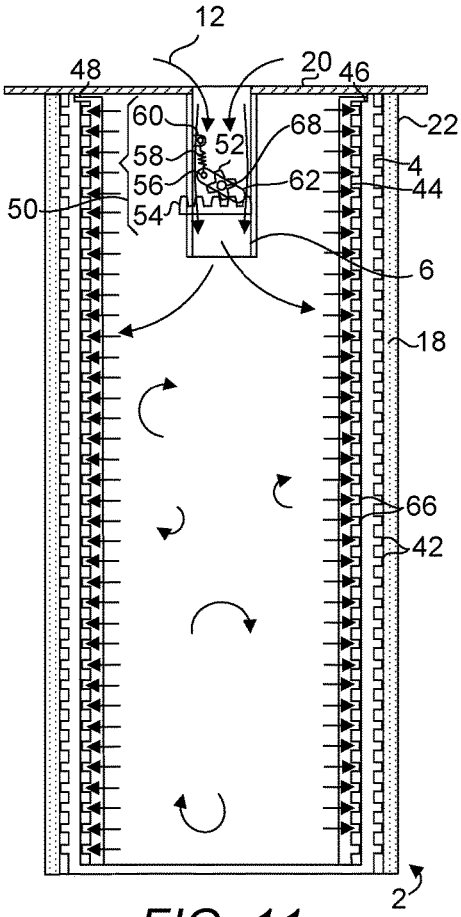
FIG. 11 is a partial orthogonal cross-sectional view of the burner of FIG. 3 taken along line AA of FIG. 3, depicting a second embodiment of the present burner with fuel flow.
Figure 12:
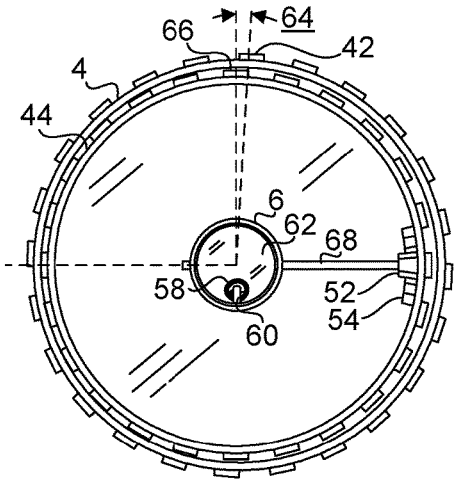
FIG. 12 is a partial top orthogonal view of the housing of the second embodiment of the present burner, depicting an inner housing disposed in a position corresponding to a fuel flow at a flowrate between the maximum and minimum settings.
Figure 13:
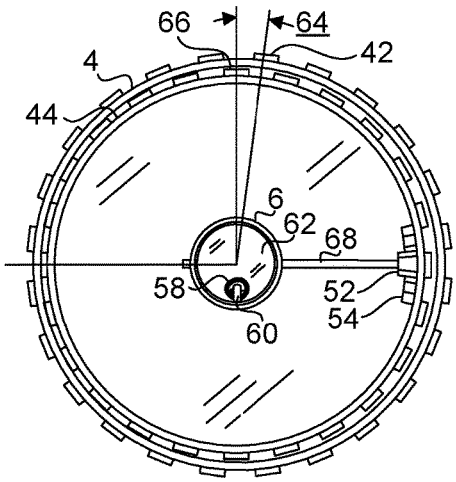
FIG. 13 is a partial top orthogonal view of the housing of the second embodiment of the present burner, depicting an inner housing disposed in a position corresponding to a fuel flow at a minimum setting.
Figure 14:
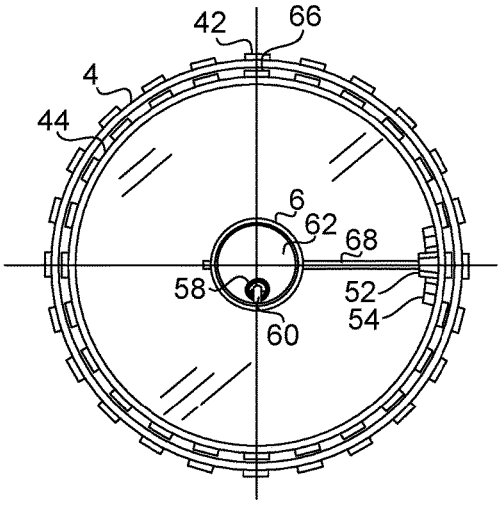
FIG. 14 is a partial top orthogonal view of the housing of the second embodiment of the present burner, depicting an inner housing disposed in a position corresponding to a fuel flow at a maximum setting.

FIGS. 10 and 11 are partial orthogonal cross-sectional views of a second embodiment of the present burner, depicting the second embodiment of the present burner 2 with and without fuel flow, respectively. FIGS. 12, 13 and 14 are partial top orthogonal views of the housing of the second embodiment of the present burner, depicting an inner housing disposed in a position corresponding to a fuel flow at a flowrate between the maximum and minimum settings, a fuel flow at a minimum setting and a fuel flow at a maximum setting, respectively. It shall be noted that the shape of the flap 62 is configured substantially according to the cross-section of the supply tube 6 with suitable clearance provided between the flap 62 and the inner surface of the supply tube 6 to avoid binding but yet allowing the flap 62 sufficient surface area to harness the forces of the fuel flow. FIGS. 12, 13 and 14 are shown with the top wall removed to more readily reveal the actuator 50. In this embodiment, in order to maintain efficient combustion at the burner surface, the size of the cavity into which fuel is supplied is not altered as in the embodiment shown in FIGS. 2-9. Instead, the effective size of the openings through which the fuel flow traverse is adjustable. Such adjustment is performed using the concept of aligning apertures of two housings to increase or decrease the openings. The amount of overlap between the plurality of apertures 66 of the inner housing 44 and the plurality of apertures 42 of the outer housing 4 determines such effective size of the openings.

In this embodiment, a second housing called the inner housing 44 is coaxially disposed within the housing or outer housing 4 such that the apertures 66 of the inner housing 44 can be aligned precisely or misaligned completely to cause openings ranging from about 0% to about 100%. As shown in FIG. 10, the inner housing 44 is essentially a hollow cylindrical tube supported at a groove 46 disposed at the top end of the housing by a lip 48 extending outwardly from the top end of the inner housing 44. More preferably, the openings are configured to range from about 5% to about 100%. Referring to FIG. 12, the housing 4 is disposed about its central axis 70 at an angular offset 64 with respect to the inner housing 44. The resulting openings are then between about 0% and about 100%. The openings can be altered by changing the magnitude of angular offset 64 to a configuration where the apertures 42 of the housing 4 are completely misaligned with the apertures 66 of the inner housing 44 as shown in FIG. 13 and another configuration where the apertures 42 of the housing 4 are wholly aligned with the apertures 66 of the inner housing 44 as shown in FIG. 14. Apertures 42, 66 of suitable sizes and shapes may be used to yield a substantially linear proportional correlation between the angle of rotation of one housing relative to another and the size of openings due to overlapping of the housings. The actuator 50 of FIG. 10 represents a mechanism capable of rotating the inner housing 44 with respect to the housing 4. In this embodiment, the actuator 50 includes a flap 62 disposed within the lumen of the supply tube 6 for harnessing the power exerted by the fuel flow in causing such rotation. The flap 62 is essentially a disk that is pivotably connected to the supply tube 6 such that when no flow occurs, the flap 62 is disposed in an orientation substantially perpendicular to the fuel flow within the supply tube 6 (i.e., in a closed orientation as shown in FIG. 10) and when a flow occurs, the flap 62 rotates in a direction to an open orientation as shown in FIG. 10 to allow flow through the supply tube 6. The edges of the disk are rounded so that the flap transitions smoothly from one orientation to another. Referring to FIGS. 10-14, a shaft 68 fixedly connected to the flap 62 extends from the supply tube 6 to an end having a pinion 52. A rack 54 fixedly mounted on a portion of the inner surface of the inner housing 44 is configured to cooperate with the pinion 52. As the flap 62 rotates, the pinion 52 rotates with it, causing rotary motion of the inner housing 44 with respect to the outer housing 4. The actuator 52 has been configured such that the degree of rotation of the flap 62 is directly proportional to the effective combustion area of burner. It shall be noted that in the second embodiment, the supply tube 6 of the second embodiment may be configured substantially shorter than the supply tube shown in FIGS. 2-9 as the lumen of the inner housing is filled in its entirety regardless of the fuel flowrate. The difference between a low fuel flowrate and a high fuel flowrate lies in the effective apertures leading to the fibrous burner surface 18. As a fuel flow ceases, a return spring 58 causes the flap 62 to return to its orientation as shown in FIG. 10. The return spring 58 is pivotably connected at one end to an anchor 60 disposed on a portion of inner wall of the supply tube 6 and pivotably connected at another end to a portion 56 of the flap 62.

In yet another embodiment, the housings 4, 44 may be configured such that relative linear axial movements of the housings 4, 44 are used to determine the amount of overlaps of their corresponding apertures 42, 66. In this embodiment, the housings 4, 44 may be configured in a different shape, e.g., rectangular or square.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A high turn-down burner adapted to receive a fuel flow for combustion, said burner comprising:

(a) an outer housing comprising a central axis, a side wall having a top edge and a bottom edge, a plurality of apertures disposed on said side wall, a top wall adjoining said side wall at said top edge and a bottom wall adjoining said side wall at said bottom edge;

(b) an inner housing comprising a central axis, a side wall, a plurality of apertures disposed on said side wall, wherein said inner housing is configured to be coaxially inserted in said housing such that said inner housing is coaxially rotatable with respect to said outer housing; and (c) an actuator adapted to harness and convert the power exerted by the fuel flow to a rotation of said inner housing with respect to said outer housing, wherein the alignment of said plurality of apertures of said inner housing and said plurality of apertures of said outer housing are configured such that said rotation is adapted to modify an effective combustion area of said burner which is defined by the amount of overlap between said plurality of apertures of said inner housing and said plurality of apertures of said outer housing.

2. The high turn-down burner of claim 1, wherein said actuator comprises:

(a) a supply tube adapted through said top wall of said outer housing, said supply tube comprising a side wall, a top end and a bottom end, wherein said supply tube is adapted to receive the fuel flow at said top end of said supply tube;

(b) a flap having a shaft fixedly attached to the flap, wherein said shaft is pivotably mounted within the lumen of said supply tube about a rotational axis, said shaft is disposed substantially perpendicularly to the fuel flow within said supply tube, said shaft extending from said flap and terminating in a pinion configured for rotational engagement with a rack mounted to a portion of an inner surface of said inner housing; and (c) a return spring secured at one end to a portion of an inner surface of said supply tube and at another end to a portion of said flap, wherein said flap is adapted to rotate about said rotational axis at a magnitude commensurate with the magnitude of the fuel flow to cause a relative rotation of said pinion with respect with said rack and said return spring is configured to return said flap to its neutral position when the fuel flow ceases.

3. The high turn-down burner of claim 1, further comprising a fibrous burner surface disposed along an outer surface of said outer housing for aiding in distributing the fuel flow over said outer surface of said outer housing.

4. The high turn-down burner of claim 1, further comprising an external housing disposed along an outer surface of said outer housing, said external housing having a side wall and a plurality of apertures disposed on said side wall, wherein said plurality of apertures are configured for aiding in distributing the fuel flow over said outer surface of said outer housing.

5. The high turn-down burner of claim 1, wherein the fuel flow is a premixed fuel flow selected from the group consisting of air-propane flow and air-natural gas flow.

* * * * *